US011731180B2

(12) United States Patent
Zhu et al.

(10) Patent No.: US 11,731,180 B2
(45) Date of Patent: Aug. 22, 2023

(54) ROTARY MOLD EXTRUSION MOLDING PROCESS OF SCREW PUMP ROTOR

(71) Applicant: ZHEJIANG OCEAN UNIVERSITY, Zhoushan (CN)

(72) Inventors: Baikang Zhu, Zhoushan (CN); Hengcong Tao, Zhoushan (CN); Le Zhang, Zhoushan (CN); Bo Ding, Zhoushan (CN)

(73) Assignee: ZHEJIANG OCEAN UNIVERSITY, Zhoushan (CN)

( * ) Notice: Subject to any disclaimer, the term of this patent is extended or adjusted under 35 U.S.C. 154(b) by 0 days.

(21) Appl. No.: 17/640,356

(22) PCT Filed: Jan. 6, 2022

(86) PCT No.: PCT/CN2022/070441
§ 371 (c)(1),
(2) Date: Mar. 4, 2022

(87) PCT Pub. No.: WO2022/100762
PCT Pub. Date: May 19, 2022

(65) Prior Publication Data

US 2023/0211398 A1 Jul. 6, 2023

(30) Foreign Application Priority Data

Jan. 13, 2022 (CN) ..... 202011268009.2

(51) Int. Cl.

| | |
|---|---|
| ***B23P 15/00*** | (2006.01) |
| ***B21C 23/00*** | (2006.01) |
| ***C22C 38/50*** | (2006.01) |
| ***C21D 6/00*** | (2006.01) |
| ***C21D 1/32*** | (2006.01) |

(52) U.S. Cl.
CPC ..... *B21C 23/002* (2013.01); *C21D 1/32* (2013.01); *C21D 6/004* (2013.01); *C22C 38/50* (2013.01)

(58) Field of Classification Search
None
See application file for complete search history.

(56) References Cited

U.S. PATENT DOCUMENTS

| | | | |
|---|---|---|---|
| 8,770,955 | B2 | 7/2014 | Lamparski |
| 8,771,583 | B2 | 7/2014 | Sequeira |
| 10,208,656 | B2 | 2/2019 | Pryor et al. |

FOREIGN PATENT DOCUMENTS

| | | | | |
|---|---|---|---|---|
| CN | 105127681 A | * | 12/2015 | |
| CN | 105127681 A | | 12/2015 | |
| CN | 105127681 B | * | 3/2018 | |
| CN | 108502886 A | * | 9/2018 | ..... C01B 32/97 |
| CN | 108502886 A | | 9/2018 | |
| CN | 108642373 A | | 10/2018 | |
| CN | 110699517 A | | 1/2020 | |
| CN | 110699517 B | * | 2/2021 | |

* cited by examiner

*Primary Examiner* — Jenny R Wu
(74) *Attorney, Agent, or Firm* — True Shepherd LLC; Andrew C. Cheng

(57) ABSTRACT

The present disclosure relates to the field of screw pump technologies, and in particular to a rotary mold extrusion molding process of a screw pump rotor. The rotary mold extrusion molding process of a screw pump rotor includes: performing isothermal spheroidizing annealing for a metal embryo material after treating the metal embryo material ultrasonically for 8~30 s; performing cylindrical turning for the annealed metal embryo material and then performing sand-blasting, and soaking the metal embryo material in saponified oil for 10~30 min for lubrication treatment, where the saponified oil contains a nano-silicon carbide of 0.5%~8% which is a nano-silicon carbide mixture with particle sizes of 20~60 nm and 140~200 nm with a mixed weight ratio of 1:(2.8~4); at room temperature, placing the metal embryo material into an extrusion cylinder to perform rotary mold extrusion molding so as to obtain a finished product.

4 Claims, 6 Drawing Sheets

ROTARY MOLD EXTRUSION MOLDING PROCESS OF SCREW PUMP ROTOR

TECHNICAL FIELD

The present disclosure relates to the field of screw pump technologies, and in particular to a rotary mold extrusion molding processing of a screw pump rotor.

BACKGROUND

A screw pump is a rotary pump which conveys liquid or increases pressure by use of change or movement of an engaging space volume formed by a pump body and a screw rod, which has the advantages of smooth medium conveyance, low turbulence of discharged medium, weak pressure pulsation, small mechanical vibration, low noise, good self-suction performance, good suction performance, working capability of high rotation, insensitivity to medium viscosity, compact and simple structure, small overall size, light weight, high efficiency, reliable operation, long service life, convenient operation and repair and the like. Therefore, the screw pumps are widely used in the following four aspects: conveying liquid; realizing multi-phase mixed conveyance of liquid, gas and solid; conveying viscous medium with extremely high viscosity; and serving as hydraulic pump of a hydraulic system.

A screw pump is a liquid conveying device where a rotor is its major rotary component. Generally, the rotor is made of solid metal material and has a special spatial helical structure. In order to realize the special helical structure, a special processing device is usually adopted to perform cylindrical turning for a metal rod. However, when a metal material is subjected to plastic deformation below a recrystallization temperature, because dislocation density continuously increases, mutual intersection of dislocation movement will be aggravated, resulting in dislocation pileup group, dislocation jog, and tangle web and the like. In this case, the dislocation is hindered from further moving and deformation resistance is increased so that the strength and hardness of the metal are increased and the plasticity and toughness are decreased, resulting in loss of ability to continue deforming, which is called work hardening or cold work hardening. In an actual production, before a material is cold-worked, it is required to remove the work hardening phenomenon by softening annealing process.

However, strict requirements are imposed on normal softening annealing and cooling process. For example, when the work hardening is removed by spheroidizing annealing, spheroidizing cores will be reduced due to excessively high temperature or excessively long holding time, which will easily cause difficulty to cylindrical turning, low production efficiency, high production costs and poor performance of rotor. Therefore, it is very necessary to improve cylindrical turning performance of the metal material, reduce processing costs, and increase processing efficiency to produce rotors with better performance.

SUMMARY

In order to overcome the defects of the prior art, the present disclosure provides a rotary mold extrusion molding process of a screw pump rotor. The process features high utilization of material, low processing costs and high processing efficiency in a manufacturing process, and the screw pump rotor has the advantages of good wear resistance, good corrosion resistance, good fouling resistance, and long service life and the like.

In order to achieve the above object, the present disclosure adopts the following technical solution.

Provided is a rotary mold extrusion molding process of a screw pump rotor, including:

1) heat treatment: performing isothermal spheroidizing annealing for a metal embryo material after treating the metal embryo material ultrasonically for 8-30 s;

2) machining: performing cylindrical turning for the annealed metal embryo material and then performing sandblasting, and soaking the metal embryo material in saponified oil for 10 min~30 min for lubrication treatment, where the saponified oil contains a nano-silicon carbide of 0.5%~8% which is a nano-silicon carbide mixture with particle size of 20 nm~60 nm and 140 nm~200 nm with a mixed weight ratio of 1:(2.8-4);

3) rotary mold extrusion molding: at room temperature, placing the lubricated metal embryo material into an extrusion cylinder for rotary mold extrusion molding to obtain a finished product.

In the present disclosure, the isothermal spheroidizing annealing is firstly performed for the metal embryo material, and then, cylindrical turning is performed for the metal embryo material, and then lubrication is performed with saponified oil, and finally, a screw pump rotor with good wear resistance, good corrosion resistance, good fouling resistance and long service life is manufactured by rotary mold extrusion molding. In the isothermal spheroidizing annealing assisted with ultrasonic treatment, the homogenization degree of the metal embryo material structure can be improved to eliminate stress, so that the internal structure of the metal reaches or approaches equilibrium state. In this case, an excellent cutting performance is obtained, which helps subsequent cutting processing and reduces generation of oxide on the surface of the metal, so that the heat-treated metal embryo material has a high toughness, helping to improve the corrosion resistance and wear resistance of the screw pump rotor. Compared with use of silicon carbide with a single particle size, the silicon carbide with different particle sizes added to the saponified oil will help lubricate the metal embryo material and uniformly form a layer of film on the surface, thereby reducing friction between the metal and the extrusion cylinder during a subsequent extrusion process, decreasing material loss, and significantly improving the wear resistance, corrosion resistance, and fouling resistance of the rotor. Thus, energy consumption will be reduced and the service life is extended. In addition, when the screw pump rotor is used to convey a liquid, rotor heat can be reduced and influence on the quality of the conveyed liquid will be diminished.

In some specific examples, the metal embryo material includes the components with the following contents: carbon steel 60%~65%, chromium 20%~28%, nickel 5%~10%, titanium 0.1%~5%, zirconium ≤0.15%, wherein the carbon steel has a carbon content of 0.28%~0.32%.

In some specific examples, the mass percentage of chromium and nickel is 1:(0.28~0.36).

In some examples, the mass percentage of zirconium in the metal embryo material is 0.08%~0.15%.

The inventor of the present disclosure found through study that a metal embryo material can be made by adding chromium, nickel, titanium and zirconium with different weight contents to carbon steel and a screw pump rotor with good wear resistance, good corrosion resistance, good fouling resistance can be made with the metal embryo material through a rotary mold extrusion molding process, increasing the processing efficiency. Specifically, by controlling the addition mass percentage of chromium and nickel to 1:(0.28~0.36), the brittleness of the metal embryo material is reduced, and the toughness and strength of the metal embryo material are increased, thereby increasing the cutting performance and providing favorable effect to the wear resistance and corrosion resistance of the screw pump rotor. By adding zirconium with a mass percentage of 0.08%~0.15%, the cutting performance of the metal embryo material is improved, the surface roughness of the metal embryo material is reduced, and the wear resistance of the screw pump rotor is increased for the following reason: the addition of zirconium, chromium and nickel provides refining effect for the structure of the metal embryo material, helping improvement of structure of material and stress elimination in a heat treatment process, and thereby achieving the effect of reducing the surface roughness and improving the wear resistance.

In some specific examples, in the isothermal spheroidizing annealing process, a heating temperature is 950° C.~1050° C., a heating time is 4.5 h~5 h and a holding time is 1.5 h~4 h.

In some specific examples, in the isothermal spheroidizing annealing process, an isothermal temperature is 830° C.~850° C. and an isothermal holding time is 2 h~6 h.

In some specific examples, in the isothermal spheroidizing annealing process, the temperature of the ultrasonic treatment is $(T_1-C_{Zr}\times 40000)$° C., where $T_1$ refers to the isothermal temperature, $C_{Zr}$ refers to the addition percentage of zirconium (Zr). Study shows that by controlling the temperature of the ultrasonic treatment process, the purpose of significant crystal grain refining and structural homogenization improvement is achieved and oxide produced by the metal in a high temperature heating process is eliminated, helping to remove the internal stress of the metal embryo material, improve the processing performance, increase the strength and toughness of the material and also providing a favorable effect on fouling resistance and corrosion resistance of the material.

In some specific examples, in the isothermal spheroidizing annealing process, the annealing temperature is $(T_1-C_{Zr}\times 50000)$° C. where $T_1$ refers to the isothermal temperature, $C_{Zr}$ refers to the addition percentage content of Zirconium (Zr), and the cooling rate is 0.5° C./min~0.8° C./min. By controlling the annealing temperature and the cooling rate of the annealing process, carbide particles with an appropriate fineness are obtained and the hardness of the metal embryo material is reduced, helping subsequent molding processing, and improving the toughness and strength of the material.

In some specific examples, the rotary mold extrusion molding process can produce a finished product meeting the dimensional design requirements of the screw pump rotor according to the prior art.

With the above technical solution, the present disclosure may have the following beneficial effects:

1) In the present disclosure, in the isothermal spheroidizing annealing assisted with ultrasonic treatment, the homogenization degree of the metal embryo material structure can be improved to eliminate stress, so that the internal structure of the metal reaches or approaches equilibrium state. In this case, an excellent cutting performance is obtained, which helps subsequent cutting processing and reduces generation of oxide on the surface of the metal, so that the heat-treated metal embryo material has a high toughness, helping to improve the corrosion resistance and wear resistance of the screw pump rotor. Compared with use of silicon carbide with a single particle size, the silicon carbide with different particle sizes added to the saponified oil will help lubricate the metal embryo material and uniformly form a layer of film on the surface, thereby reducing friction between the metal and the extrusion cylinder during a subsequent extrusion process, decreasing material loss, and significantly improving the wear resistance, corrosion resistance, and fouling resistance of the rotor. Thus, energy consumption will be reduced and the service life is extended. In addition, when the screw pump rotor is used to convey a liquid, rotor heat can be reduced and influence on the quality of the conveyed liquid will be diminished.

2) By controlling the addition mass percentage of chromium and nickel to 1:(0.28-0.36), the brittleness of the metal embryo material is reduced, and the toughness and strength of the metal embryo material are increased, thereby increasing the cutting performance and providing favorable effect to the wear resistance and corrosion resistance of the screw pump rotor. By adding zirconium with a mass percentage of 0.08%~0.15%, the cutting performance of the metal embryo material is improved, the surface roughness of the metal embryo material is reduced, and the wear resistance of the screw pump rotor is increased for the following reason: the addition of zirconium, chromium and nickel provides refining effect for the structure of the metal embryo material, helping improvement of structure of material and stress elimination in a heat treatment process, and thereby achieving the effect of reducing the surface roughness and improving the wear resistance.

3) In the present disclosure, by controlling the temperature of the ultrasonic treatment process, the purpose of significant crystal grain refining and structural homogenization improvement is achieved and oxide produced by the metal in a high temperature heating process is eliminated, helping to remove the internal stress of the metal embryo material, improve the processing performance, increase the strength and toughness of the material and also providing a favorable effect on fouling resistance and corrosion resistance of the material.

4) By controlling the annealing temperature and the cooling rate of the annealing process, carbide particles with an appropriate fineness are obtained and the hardness of the metal embryo material is reduced, helping subsequent molding processing, and improving the toughness and strength of the material.

BRIEF DESCRIPTIONS OF THE DRAWINGS

In order to make the above or other objects, features, advantages and examples of the present disclosure more understandable, the following drawings are provided.

DETAILED DESCRIPTIONS OF PREFERRED EMBODIMENTS

Figure 1:
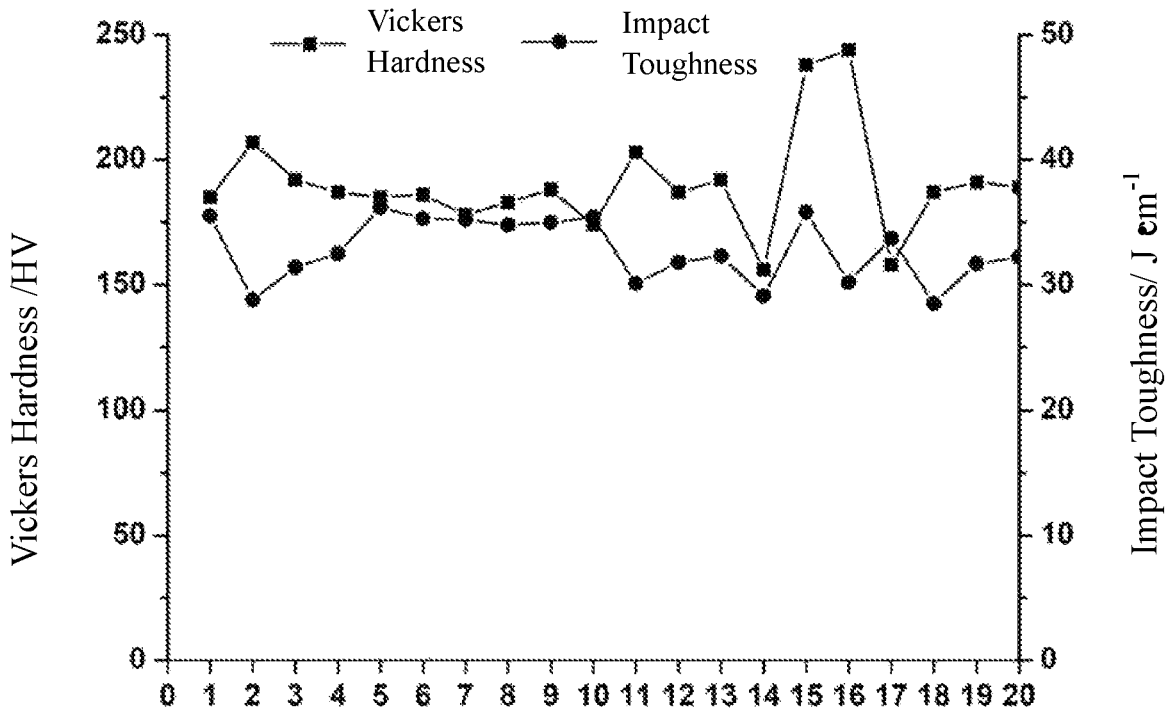
FIG. 1 is a schematic diagram of a test result of Vickers hardness and impact toughness of a heat-treated metal embryo material according to the present disclosure.

In order to help persons skilled in the art to understand the features and effects of the present disclosure, the terms or words used in the specification and the claims are defined in a general sense. Unless otherwise defined, the technologies and scientific terms in the present disclosure have the same meaning as persons skilled in the art can understand. In a case of any conflict, the definition of the specification shall prevail.

In the present disclosure, a nano-silicon carbide can be prepared with the prior art, including but not limited to:

mixing expandable graphite and silicon powder at a weight ratio of (2.5~6):1, grinding for 20 min~60 min by vibration, and then heating to 1300° C.~1450° C. and protecting reaction for 4 h~6 h under the protection of argon gas, and cooling down to room temperature to obtain a reaction product after reaction; soaking the reaction product in a hydrofluoric acid solution and a sodium hydroxide solution in sequence for at least 16 h, and then washing with de-ionized water to neural; adding the nano-silicon carbide into de-ionized water with 1.5~2 weight folds, adding a sodium silicate dispersant of 0.5%~1% to the slurry, obtaining a micropowder solution of different particle sizes after grading, and performing centrifugal spray and drying for the micropowder solution to obtain the nanoscale silicon carbide.

In the above process, the heating rate is 2° C./min~8° C./min, the cooling temperature is 4° C./min~10° C./min, the concentration of the hydrofluoric acid solution is 5%~10%, and the concentration of the sodium hydroxide solution is 8%~15%.

The technical solution of the present disclosure will be further described in combination with specific examples and the accompanying drawings.

Example 1: a rotary mold extrusion molding process of a screw pump rotor

The example provides a rotary mold extrusion molding process of a screw pump rotor, which specifically includes the following steps.

1) Heat treatment: a metal embryo material was heated to 1050° C. in 5 h, held for 3 h, cooled down to 840° C., and subjected to isothermal holding of 5 h, and then treated ultrasonically for 20 s at the temperature of 800° C. with an ultrasonic treatment frequency of 20 kHz and a power density of 2.6 W/cm$^2$, and then cooled down to 790° C. along with a furnace, and finally annealed with the cooling rate of 0.65° C./min, where the metal embryo material included carbon steel (carbon content 2.06%) 64.5%, chromium 24%, nickel 8%, titanium 3.4%, zirconium 0.1%, where the mass ratio of chromium and nickel was 1:0.33.

2) Machining: cylindrical turning was performed for the annealed metal embryo material to a diameter of Φ49, and then the metal embryo material was soaked in a saponified oil (sodium stearate) for 30 min for lubrication treatment, where a nano-silicon carbide of 3.2% was added to the saponified oil, the nano-silicon carbide was a nano-silicon carbide mixture of 20 nm~60 nm and 140 nm~200 nm with a weight ratio of 1:3.6, the nano-silicon carbide was prepared in the following method: mixing expandable graphite and silicon powder at a weight ratio of 4:1, grinding for 60 min by vibration, and then heating to 1400° C. at the heating rate of 6° C./min and protecting reaction for 6 h under the protection of argon gas, and cooling down to room temperature at the cooling rate of 8° C./min to obtain a reaction product after reaction; soaking the reaction product in a hydrofluoric acid solution of 8% and a sodium hydroxide solution of 8% in sequence for 20 h , and then washing with de-ionized water to neural; adding the nano-silicon carbide into de-ionized water with 1.5 weight folds, adding a sodium silicate dispersant of 0.8% to the slurry, obtaining a micropowder solution of different particle sizes after grading, and performing centrifugal spray and 70° C. drying for the micro-powder solution to obtain the nano-scale silicon carbide.

3) Rotary mold extrusion molding: at room temperature, the lubricated metal embryo material was placed into an extrusion cylinder to perform rotary mold extrusion molding so as to obtain a finished product.

A unit pitch length for extrusion of the metal embryo material was set to 65 mm according to the prior art. When the rotary mold completed one turn of 360° rotation, a torque set for the rotary mold can ensure the embryo material rotated smoothly in the rotary mold; the screw pump rotor molded by the metal embryo material had a spatial helical structure with a pitch of 65 mm, an eccentric distance of 7 mm and sectional circular diameter of Φ49.

Example 2

The example differs from the example 1 in that the metal embryo material was carbon steel without addition of chromium, nickel, titanium and zirconium.

Example 3

The example differs from the example 1 in that the metal embryo material included carbon steel 64.5%, chromium 25%, nickel 6%, titanium 4.4% and zirconium 0.1%, where the mass ratio of chromium to nickel was 1:0.24.

Example 4

The example differs from the example 1 in that the metal embryo material included carbon steel 62.5%, chromium 28%, nickel 8%, titanium 1.4% and zirconium 0.1%, where the mass ratio of chromium to nickel was 1:0.28.

Example 5

The example differs from the example 1 in that the metal embryo material included carbon steel 62.5%, chromium 25%, nickel 9%, titanium 3.4% and zirconium 0.1%, where the mass ratio of chromium to nickel was 1:0.36.

Example 6

The example differs from the example 1 in that the metal embryo material included carbon steel 62.5%, chromium 22.5%, nickel 9%, titanium 4.4% and zirconium 0.1%, where the mass ratio of chromium to nickel was 1:0.4.

Example 7

The example differs from the example 1 in that the metal embryo material included carbon steel 64.5%, chromium 24%, nickel 8%, titanium 3.5% with addition of zirconium, where the ultrasonic treatment temperature was 800° C.

Example 8

The example differs from the example 1 in that the metal embryo material included carbon steel 64.52%, chromium 24%, nickel 8%, titanium 3.4% and zirconium 0.08%, where the ultrasonic treatment temperature was 808° C. and the annealing temperature was 800° C.

Example 9

The example differs from the example 1 in that the metal embryo material included carbon steel 64.5%, chromium 24%, nickel 8%, titanium 3.35% and zirconium 0.15%, where the ultrasonic treatment temperature was 780° C. and the annealing temperature was 765° C.

Example 10

The example differs from the example 1 in that the metal embryo material included carbon steel 64%, chromium 24%, nickel 8%, titanium 3.8% and zirconium 0.2%, where the ultrasonic treatment temperature was 760° C. and the annealing temperature was 740° C.

Example 11

The example differs from the example 1 in that the specific operation steps of the heat treatment process included: heating the metal embryo material to 1050° C., holding for 3 h, and cooling down to 840° C., and performing isothermal holding for 5 h, and next, cooling down to 790° C. along with a furnace, and finally annealing at the cooling rate of 0.65° C./min; where no ultrasonic treatment was performed.

Example 12

The example differs from the example 1 in that the specific operation steps of the heat treatment process included: the ultrasonic treatment temperature 740° C.

Example 13

The example differs from the example 1 in the ultrasonic treatment temperature 840° C.

Example 14

The example differs from the example 1 in the annealing temperature 730° C.

Example 15

The example differs from the example 1 in the annealing temperature 810° C.

Example 16

The example differs from the example 1 in the cooling rate 0.2° C./min of the annealing.

Example 17

The example differs from the example 1 in the cooling rate 1° C./min of the annealing.

Example 18

The example differs from the example 1 in that the saponified oil did not contain silicon carbide at the time of lubrication treatment.

Example 19

The example differs from the example 1 in that the nano-silicon carbide in the saponified oil had a particle size of 20-60 nm at the time of lubrication treatment.

Example 20

The example differs from the example 1 in that the nano-silicon carbide in the saponified oil had a particle size of 140-200 nm at the time of lubrication treatment.

In order to verify the technical effect of the present disclosure, the following test was performed for the heat-treated metal embryo material in the present disclosure.

Experimental example 1

Impact toughness, Vickers hardness, yield strength and tensile strength of the metal embryo material were tested:

Reference was made to GB/T4340.3-1999 for the test of Vickers hardness of the metal embryo material, to GB/T33144-2016 for the test of impact toughness, to GB/T228.1-2010 for the test of yield strength and tensile strength. The test results of the impact toughness and the Vickers hardness are illustrated in FIG. 1, and the test results of the yield strength and the tensile strength are illustrated in FIG. 2.

As shown in FIG. 1, in the process of manufacturing the screw pump rotor with the process of the present disclosure, the heat-treated metal embryo material has a Vickers hardness between 156 HV and 244 HV. Comparison of the examples 1 and 14-17 shows the annealing temperature and the cooling rate have great influence on the hardness of the metal embryo material; it can be seen from the test result of impact toughness that that the heat-treated metal embryo material has an increased toughness, and decreased brittleness, facilitating subsequent molding process. Also, it shows that the addition mass ratio of chromium to nickel in the metal embryo material, ultrasonic treatment, and annealing treatment have a significant effect on the toughness of the metal embryo material.

Figure 2:
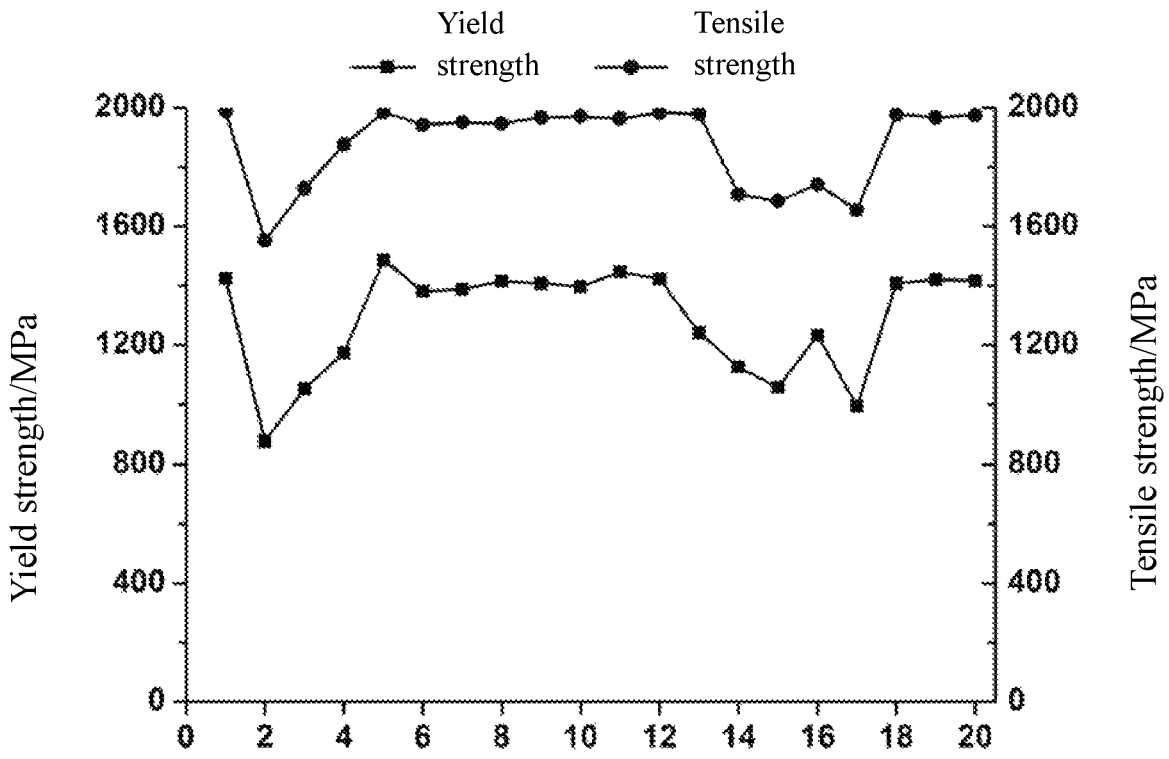
FIG. 2 is a schematic diagram of a test result of yield strength and tensile strength of a heat-treated metal embryo material according to the present disclosure.

As shown in FIG. 2, in the process of manufacturing the screw pump rotor with the process of the present disclosure, the heat-treated metal embryo material has a high yield strength and tensile strength. Comparison of examples 1-6 shows that addition of chromium and nickel into the metal embryo material helps to improve the strength of the metal embryo material, and the addition weight ratio of chromium to nickel also has significant effect on the strength of the material. Comparison of example 1 and 16-17 shows that the temperature and the cooling rate of the annealing treatment have great effect on the strength of the metal embryo material.

Experimental example 2

Figure 3:
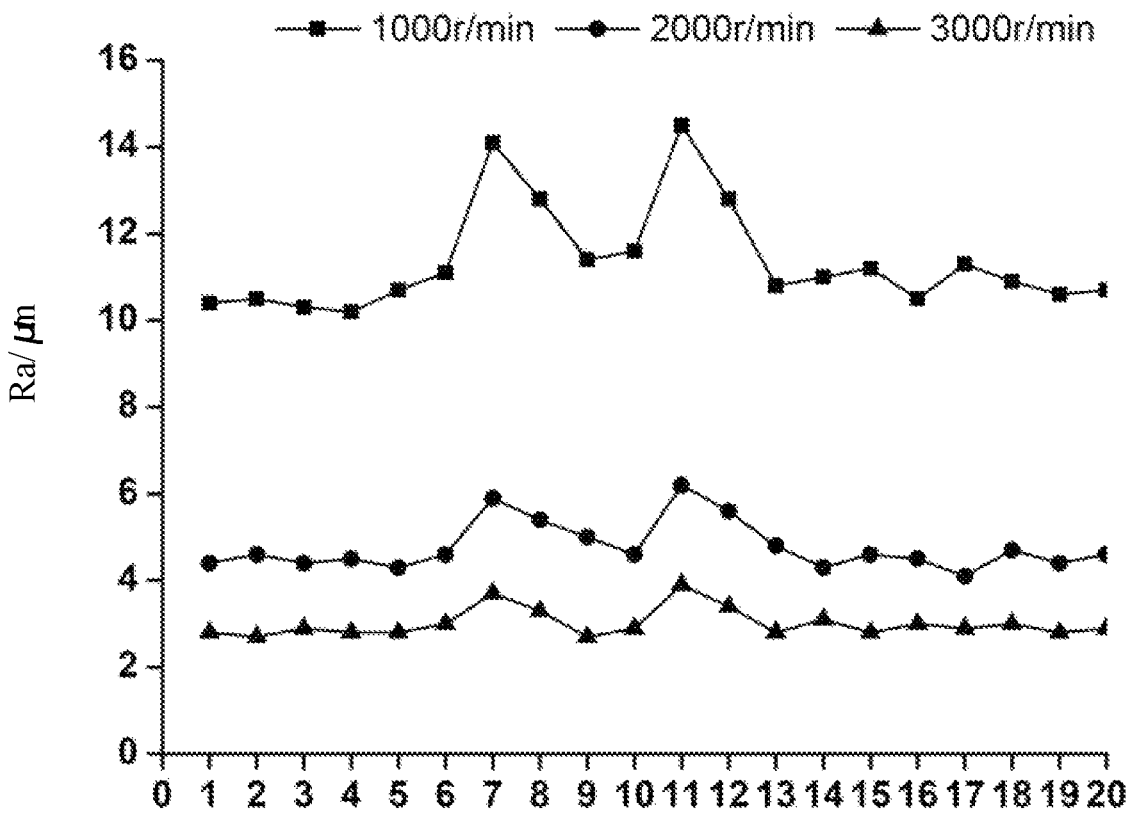
FIG. 3 is a schematic diagram of a test result of processing performance (surface roughness) of a heat-treated metal embryo material according to the present disclosure.

In order to test the processing performance of the metal embryo material, turning test was performed for the metal embryo material. The processing performance was determined by detecting the structural integrity and the surface roughness of the turned metal material. In the turning test, the workpiece rotation was 1000 r/min, 2000 r/min and 3000 r/min, the blade feed rate was 0.05 mm/r, the cutting depth was 0.2 mm. The test result of the surface roughness (Ra/μm) is illustrated in FIG. 3.

It is found that the metal embryo material can maintain its structural integrity under the rotations of 1000 r/min, 2000 r/min and 3000 r/min during a turning test, resulting in no breaking phenomenon. It is found from data of FIG. 2 that by comparing the surface roughnesses under different rotations, the surface roughness of the metal material increases when the rotation is low and decreases when the rotation increases. Comparison of examples 1 and 7-10 shows that the addition of zirconium to the metal embryo material helps to improve the cutting processing performance, and the surface roughness of the turned material is low. However, the insufficient or excessive addition amount has influence on the processing performance of the material. Comparison of examples 1 and 11-13 shows that the ultrasonic treatment helps to improve the processing performance of the material.

Test was also performed for wear resistance, fouling resistance and corrosion resistance of the screw pump rotor in the present disclosure.

Experimental example 3

Reference was made to GB/T12444-2006 for the test of wear resistance of the screw pump rotor, with alloy wear resistance represented by friction coefficient and volume wear amount. The test result is shown in FIG. 4.

Figure 4:
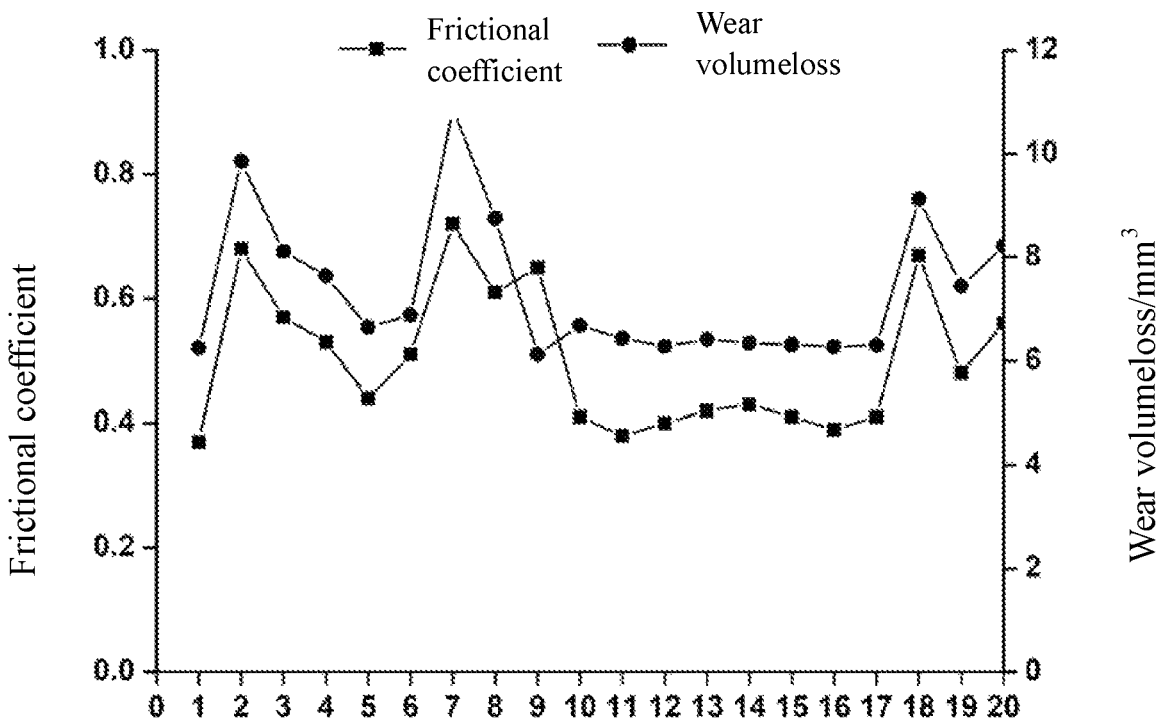
FIG. 4 is a schematic diagram of a test result of wear-resistance (friction coefficient, volume wear amount) of a screw pump rotor according to the present disclosure.

The data of FIG. 4 shows a friction coefficient of the screw pump rotor under a load of 100N. The data shows that the screw pump rotor prepared with the process of the present disclosure has an excellent wear resistance and a long service life. The addition of chromium and nickel to the metal embryo material helps to improve the wear resistance of the rotor, and zirconium with the addition mass percentage of 0.08-0.15% to the metal embryo material helps to significantly reduce the surface roughness of the metal embryo material, thereby increasing the wear resistance of the screw pump rotor. Further, the addition of silicon carbide to the saponified oil can further increase the wear resistance of the rotor.

Experimental example 4

The fouling resistance of the screw pump rotor was tested in the following method: the fouling resistance was evaluated according to a weight increase (fouling amount) after the screw pump rotor with a particular mass was soaked in hard water of 50±5° C. for 30 d, wherein in hard water, $[Ca^{2+}]$=600±10 mg/L, $[HCO_3^-]$=600±10 mg/L, and $[SO_4^{2-}]$ =300±10 mg/L. The test result is shown in FIG. 5.

Figure 5:
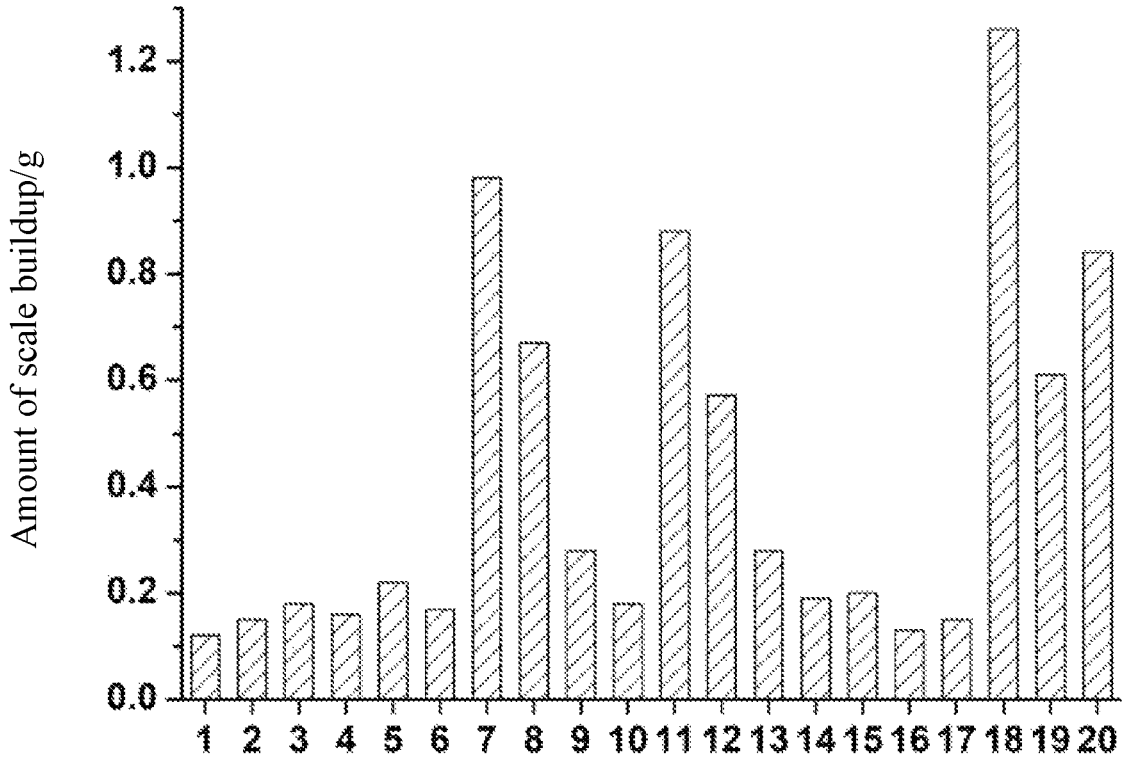
FIG. 5 is a schematic diagram of a test result of fouling resistance (fouling amount) of a screw pump rotor according to the present disclosure.

As shown in FIG. 5, the screw pump rotor prepared by the process of the present disclosure has an excellent fouling resistance with its minimum fouling amount after being soaked in hard water of 50° C.±5° C. for 30 d being 0.12 g. It also shows that the addition of silicon carbide to the saponified oil has significant effect on the fouling resistance of the rotor. Further, the addition of zirconium to the metal embryo material also helps to improve the fouling resistance of the rotor.

Experimental example 5

The corrosion resistance of the screw pump rotor was tested in the following method: soaking the screw pump rotor in hard waters with pH=5.5 and 8 respectively to evaluate the corrosion resistance of the screw pump rotor by observing the time that the visible corrosion trace appears on the screw pump rotor, with its test result shown in FIG. 6.

Figure 6:
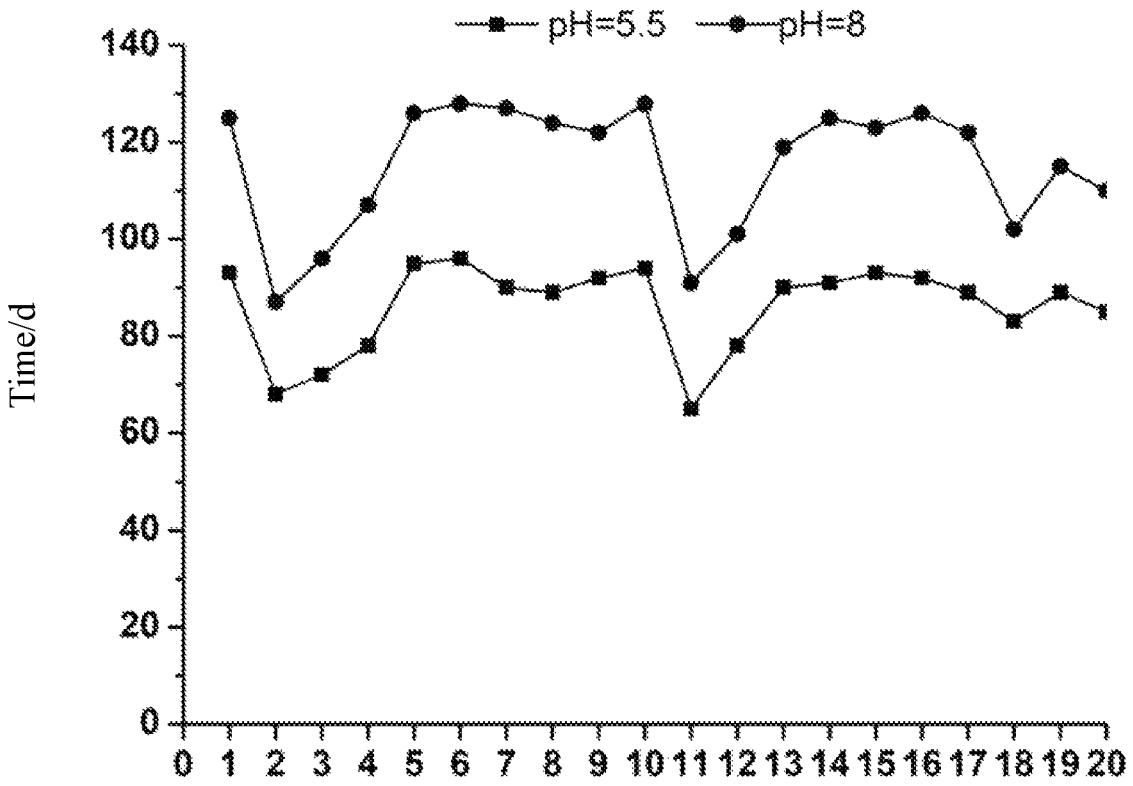
FIG. 6 is a schematic diagram of a test result of corrosion resistance (a time in which visible corrosion trace appears) of a screw pump rotor according to the present disclosure.

As shown in FIG. 6, the screw pump rotor has a much better corrosion resistance under an alkali condition than under an acid condition. It also shows that the addition of chromium and nickel to the metal embryo material may greatly improve the corrosion resistance of the screw pump rotor, the addition weight ratio of chromium to nickel also helps to increase the corrosion resistance of the screw pump rotor, and the addition of nano-silicon carbide to the saponified oil during an ultrasonic treatment and lubrication treatment also helps to increase the corrosion resistance of the screw pump rotor.

Although several examples are described in the present disclosure, those skilled in the present disclosure shall understand that any change may be made to these examples of the present disclosure without departing from the spirit of the present disclosure. The above examples are merely illustrative and the scope of protection of the present disclosure is only defined by the appended claims.

Other matters not mentioned in the present disclosure belong to the common knowledge.

What is claimed is:

1. A rotary mold extrusion molding process of a screw pump rotor, comprising:

1) heat treatment: performing a high-temperature heat treatment for a metal embryo material, and then performing isothermal spheroidizing annealing for the metal embryo material after ultrasonic treatment of the metal embryo material for 8 s~30 s;

2) machining: performing cylindrical turning for the annealed metal embryo material, and then performing sand blasting and then soaking the metal embryo material in saponified oil for 10 min~30 min for lubrication treatment, wherein the saponified oil contains a nano-silicon carbide of 0.5%~8%, the nano-silicon carbide is a nano-silicon carbide mixture with particle sizes of 20-60 nm and 140 nm~200 nm and a ratio of weight of particles of 20-60 nm in size and particles of 140-200 nm in size is in a range from 1:2.8 to 1:4; and 3) rotary mold extrusion molding: at room temperature, placing the lubricated metal embryo material into an extrusion cylinder to perform rotary mold extrusion molding so as to obtain a finished product;

Wherein the metal embryo material contains components with the following contents by weight: carbon steel 60%~65%, chromium 20%~28%, nickel 5%~10%, titanium 0.1%~5%, and zirconium ≤0.15%, and a carbon content in the carbon steel is 0.28%~0.32%; a ratio of a mass percentage of chromium to nickel in the metal embryo material is in a range from 1:0.28 to 1:0.36;

in the isothermal spheroidizing annealing process, an ultrasonic treatment temperature is $(T_1-C_{Zr}\times40000)$° C., $T_1$ refers to an isothermal temperature, $C_{Zr}$ refers to a mass percent content of Zirconium (Zr);

the mass percent content of zirconium in the metal embryo material is 0.1%~0.15%;

in the isothermal spheroidizing annealing process, an annealing temperature is $(T_1-C_{Zr}\times50000)$° C., $T_1$ refers to the isothermal temperature, $C_{Zr}$ refers to the mass percent content of Zirconium (Zr), and a cooling rate is 0.5~0.8° C./min;

the metal embryo material has a Vickers hardness between 156 HV and 244 HV, and a minimum fouling amount after being soaked in hard water of 50° C.±5° C. for 30 d is 0.12 g;

in the high-temperature heat treatment process, a heating temperature is 950° C.~1050° C., a heating time is 4.5 h~5 h, a holding time is 1.5 h~4 h, an isothermal temperature is 830° C.~850° C., and an isothermal holding time is 2 h~6 h.

2. The rotary mold extrusion molding process according to claim 1, wherein a frequency of the ultrasonic treatment is 20 kHz~25 kHz and a power density is 2.5 W/cm$^2$~2.8 W/cm$^2$.

3. The rotary mold extrusion molding process according to claim 1, wherein the nano-silicon carbide is prepared by the following method:

1) mixing expandable graphite and silicon powder with a weight ratio thereof in a range from 2.5:1 to 6:1, grinding for 20 min~60 min by vibration, and then heating to 1300° C.~1450° C. and protecting reaction for 4 h~6 h under the protection of argon gas, and cooling down to room temperature to obtain a reaction product after reaction;

2) soaking the reaction product in a hydrofluoric acid solution and a sodium hydroxide solution in sequence for at least 16 h, and then washing with de-ionized water to neural;

3) adding the nano-silicon carbide into de-ionized water, adding a sodium silicate dispersant of 0.5 mass %~1 mass % to the slurry, obtaining a micropowder solution of different particle sizes after grading, and performing centrifugal spray and drying for the micropowder solution to obtain the nanoscale silicon carbide.

4. The rotary mold extrusion molding process according to claim 3, wherein in the preparation process of the nano-silicon carbide, the heating rate of heating to 1300-1450° C. is 2° C./min~8° C./min, and the cooling rate of cooling down to room temperature is 4° C./min~10° C./min.

* * * * *